US010752012B2

(12) United States Patent
Lee et al.

(10) Patent No.: US 10,752,012 B2
(45) Date of Patent: Aug. 25, 2020

(54) INK CONTAINER FOR INKJET PRINTER

(71) Applicant: GOSANTECH CO., LTD., Cheonan-si, Chungcheongnam-do (KR)

(72) Inventors: Sung-hee Lee, Cheonan-si (KR); Kwang-su Kim, Cheonan-si (KR)

(73) Assignee: GOSANTECH CO., LTD, Cheonan-si (KR)

( * ) Notice: Subject to any disclaimer, the term of this patent is extended or adjusted under 35 U.S.C. 154(b) by 0 days.

(21) Appl. No.: 16/517,939

(22) Filed: Jul. 22, 2019

(65) Prior Publication Data

US 2020/0180322 A1 Jun. 11, 2020

(30) Foreign Application Priority Data

Dec. 10, 2018 (KR) ..... 10-2018-0158077

(51) Int. Cl.

| | |
|---|---|
| ***B41J 2/19*** | (2006.01) |
| ***B41J 2/17*** | (2006.01) |
| ***B41J 2/175*** | (2006.01) |
| ***B41J 2/18*** | (2006.01) |

(52) U.S. Cl.

CPC ..... *B41J 2/19* (2013.01); *B41J 2/1707* (2013.01); *B41J 2/17513* (2013.01); *B41J 2/17596* (2013.01); *B41J 2/18* (2013.01); *B41J 2202/07* (2013.01)

(58) Field of Classification Search

CPC ..... B41J 2/19; B41J 2/17513; B41J 2/1707; B41J 2/18; B41J 2/17596; B41J 2202/07

See application file for complete search history.

(56) References Cited

U.S. PATENT DOCUMENTS 8,020,982 B2 * 9/2011 Mun ..... B41J 2/1707 347/92

2006/0061637 A1 3/2006 Therien et al.

FOREIGN PATENT DOCUMENTS

| | | | |
|---|---|---|---|
| JP | 2009-83374 | A | 4/2009 |
| JP | 2012-16823 | A | 1/2012 |
| JP | 2012-210824 | A | 11/2012 |
| KR | 20-0370924 | Y1 | 12/2004 |
| KR | 10-1168989 | B1 | 7/2012 |

OTHER PUBLICATIONS

Translation of KR-200370924, published on Dec. 2004. (Year: 2004).*

* cited by examiner

*Primary Examiner* — Huan H Tran

(74) *Attorney, Agent, or Firm* — Sughrue Mion, PLLC

(57) ABSTRACT

The present invention relates to an ink container for an inkjet printer, the ink container being configured to prevent a problem caused by fine bubbles accumulated in the ink container. As the ink container containing ink for supplying ink to an inkjet head having a plurality of nozzles that discharge ink, the ink container includes: a bottom surface inclined so that a first side thereof connected to a return line through which ink is returned from the inkjet head is positioned higher than a second side thereof connected to a supply line through which ink is supplied to the inkjet head; and a bubble removing net provided between the supply line and the return line to remove bubbles from ink contained in the ink container.

10 Claims, 4 Drawing Sheets

INK CONTAINER FOR INKJET PRINTER

CROSS REFERENCE TO RELATED APPLICATION

The present application claims priority to Korean Patent Application No. 10-2018-0158077, filed Dec. 10, 2018, the entire contents of which is incorporated herein for all purposes by this reference.

BACKGROUND OF THE INVENTION

Field of the Invention

The present invention relates generally to a container containing ink for supplying the ink to an inkjet head used in an inkjet printer and, more particularly, to an ink container for an inkjet printer used in various industrial fields.

The present invention is supported by Korean national research project.

Project Number: S2633949

Department: Ministry of SMEs and Startups

Research management agency: Korea Business Angels Association

Research Project Title: Private-leading Startup Incubating Project (Tech Incubator Program for Startup Korea)

Research Subject Title: Development of Negative pressure Control Device for OLED RGB Inkjet Pattern Printing

Description of the Related Art

Generally, an inkjet printing method of ejecting liquid ink on a surface of a medium in the form of droplets in accordance with a figure signal is used not only for printing of documents and leaflets but also for solution processing in industrial fields of semiconductor or display.

An application range of inkjet printing which can form a complicated pattern on a substrate or accurately discharge ink on a specific position has been wide. A small inkjet printer for document writing has a form of containing ink in an inkjet head for ejecting ink droplets, but a large document printer or an industrial-use inkjet printer uses a large amount of ink, and a structure in which an ink container and an inkjet head are separated from each other is applied thereto.

In order to discharge an exact amount of ink in the inkjet printing process, it is necessary to maintain the ink a meniscus state in which the surface of the ink ready for ejection from the inkjet head has concave shape due to capillary action with respect to a nozzle inlet. Accordingly, to prevent the ink from flowing down in the inkjet head to maintain the meniscus state thereof, positioning the ink container higher than that of the inkjet head and by generating a negative pressure inside the ink container is generally performed.

Meanwhile, in the inkjet printer, since ink droplets are discharged through a nozzle of the inkjet head, air may be introduced through the nozzle between the droplets to be discharged and air flows into ink in the process of supplementing ink. Likewise, due to the air introduced by various reasons, there are fine bubbles in ink and there is a problem that ink cannot be discharged when the nozzle is clogged by the bubbles. Thus, in order to prevent such problems, various methods for removing bubbles in ink have been proposed. Mostly, the methods have configurations for preventing bubbles from entering the nozzle and parts in which the bubbles cause the problems. As a result, fine bubbles are accumulated in the container in which ink is circulated and stored.

DOCUMENTS OF RELATED ART (Patent Document 1) Korean Utility Model Registration NO. 20-0370924;

(Patent Document 2) Korean Patent NO. 10-1168989.

SUMMARY OF THE INVENTION

Accordingly, the present invention has been made keeping in mind the above problems occurring in the related art, and the present invention is intended to propose an ink container for an inkjet printer, the ink container enabling removal fine bubbles accumulated therein.

In order to achieve the above object, according to one aspect of the present invention, there is provided an ink container for an inkjet printer, the ink container containing ink therein and supplying ink to an inkjet head provided with a plurality of nozzles discharging ink, the ink container includes: a bottom surface inclined so that a first side thereof connected to a return line through which ink is returned from the inkjet head is positioned higher than a second side thereof connected to a supply line through which ink is supplied to the inkjet head; and a bubble removing net provided between the supply line and the return line to remove bubbles from ink contained in the ink container.

The ink container may be configured to have the inclined bottom surface to form a constant ink flow and be provided with the bubble removing net for removing bubbles by a method of restricting the movement of bubbles in ink and floating the bubbles.

A pressure control tube connected to a pressure control device used to maintain meniscus in the inkjet head may be connected to a position opposite to a position at which the return line is connected to the container, on the basis of the bubble removing net.

In the ink container, a guard member may be provided at an inlet to which the pressure control tube is connected, the guard member being configured to be closed in a direction toward the bubble removing net and to be open in an opposite direction.

The bubble removing net may be provided as at least two bubble removing nets that may be positioned spaced apart from each other.

A horizontal groove may be provided parallel to the bottom surface, and an agitator may be provided in the horizontal groove. The agitator may be a magnetic agitator, and a fixing frame may be provided for preventing the agitator from being separated from a designated position thereof. A rotational shaft may protrude outside upper and lower ends of the agitator, and opposite ends of the rotational shaft may be partially inserted into the fixing frame and are fixed thereto.

When the horizontal groove and the agitator are respectively provided as at least two groves and agitators, sufficient dispersibility may be obtained while operating each agitator weakly.

A buffer storage part for supplementing ink to the ink container may be connected to the ink container through an inlet tube, and a position at which the inlet tube is connected to the ink container may be the same as a direction of a position at which the return line is connected to the ink container, on the basis of the bubble removing net. Since a large amount of fine bubbles is included in ink supplemented through the buffer storage part, the connection position may be formed at the return line side.

An inkjet printer according to another embodiment of the present invention, the inkjet printer includes: an inkjet head including a nozzle discharging ink in a liquid droplet state; an ink container in which ink to be supplied to the inkjet head is contained; a pressure control device connected to the ink container through a pressure control tube and maintaining a meniscus state of ink injected into the inkjet head; a supply line connected to the ink container for supplying ink from the ink container to the inkjet head; a return line connected to the ink container for returning ink remaining in the inkjet head to the ink container; and a circulating pump provided in the supply line or the return line to generate flow of ink, wherein the ink container of the inkjet printer is the aforementioned ink container.

As described above, the ink container of the present invention is provided with the bubble removing net for removing the fine bubbles accumulated in the ink container, so that it is possible to prevent problems caused by the fine bubbles in ink.

In addition, the ink container includes the agitator capable of performing stable movement, so that it is possible to increase dispersibility of particles in ink when the agitator is applied together with the ink circulation system.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Figure 1:
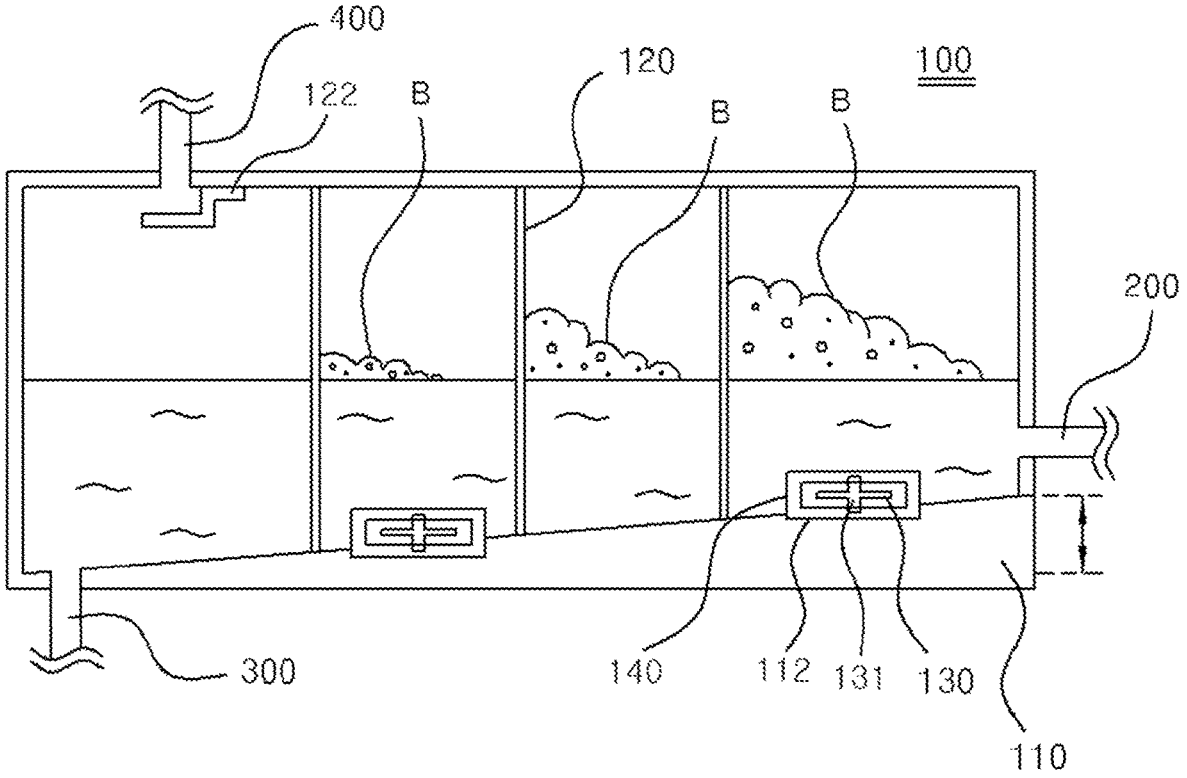
FIG. 1 is a front sectional view showing the structure of an ink container according to a first embodiment of the present invention.

Hereinbelow, exemplary embodiments of the present invention will be described in detail with reference to the accompanying drawings.

However, various changes to the following embodiments of the present invention are possible and the scope of the present invention is not limited thereto. In the drawings, the shapes and sizes of elements may be exaggerated for explicit and convenient description, the same reference numerals will refer to the same or like parts.

Throughout the specification, it will be understood that when an element is referred to as being "coupled" or "connected" to another element, it can be directly coupled or connected to the other element or it can be electrically connected with the other element and intervening elements may be present therebetween. It will be further understood that the terms "comprises", "comprising", "includes", and/or "including", when used herein, specify the presence of stated features, integers, steps, operations, elements, and/or components, but do not preclude the presence or addition of one or more other features, integers, steps, operations, elements, components, and/or groups thereof.

Terms such as "a first" and "a second" may be used for explaining various constitutive elements, but the constitutive elements should not be limited to these terms. These terms is used only for the purpose for distinguishing a constitutive element from other constitutive element. For example, a first constitutive element may be referred as a second constitutive element, and the second constitutive element may be also referred to as the first constitutive element.

Figure 2:
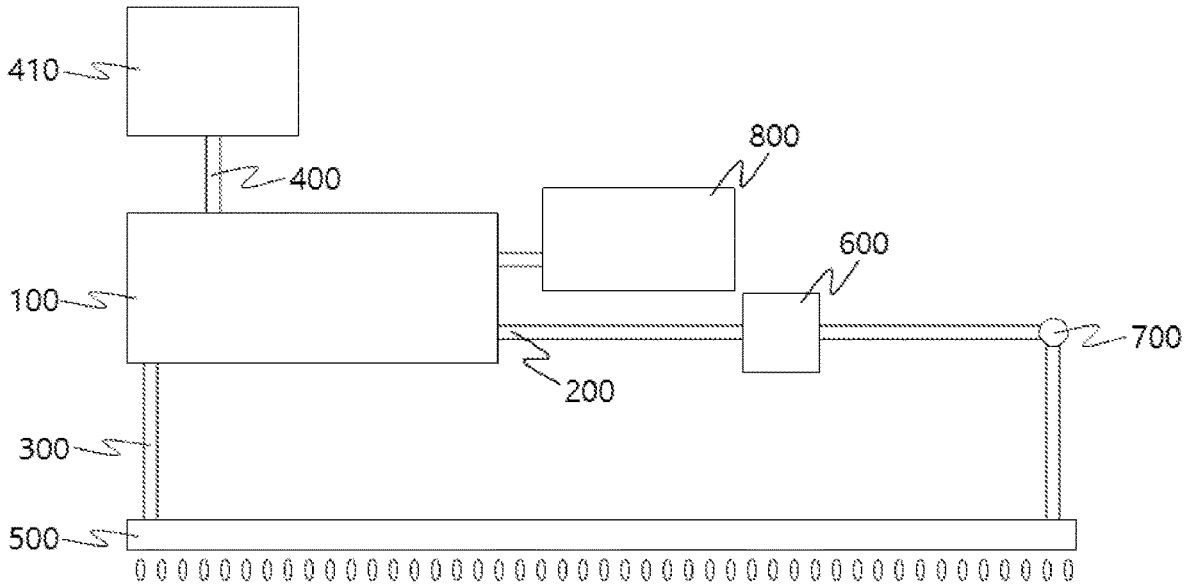
FIG. 2 is a block diagram showing an ink circulation supply structure of an inkjet printer in which the ink container is provided.

FIG. 1 is a front sectional view showing the structure of an ink container according to a first embodiment of the present invention. FIG. 2 is a block diagram showing an ink circulation supply structure of an inkjet printer in which the ink container is provided.

The ink container 100 of the present invention may be used in an inkjet printer having an ink circulation system as shown in FIG. 2, and firstly, the ink circulation system will be described.

The ink container 100 is a part containing ink so as to supply the ink to the inkjet head 500. The ink container is connected with a first end of a supply line 300 for supplying ink to the inkjet head 500 and a first end of a return line 200 through which remaining ink in the inkjet head 500 returns to the ink container, and provided with a first end of a pressure control tube 400 for maintaining a meniscus state of ink.

The inkjet head 500 is provided with a plurality of nozzles discharging ink, and the inkjet printer shown in the drawings is configured as an industrial printer, thus having a configuration in which the inkjet head 500 and the ink container 100 are separable from each other. As the detailed configuration of the inkjet head 500, technical configurations of the conventional inkjet head may be used within a range without departing from the scope and spirit of the present invention. Especially, in order to prevent the nozzles of the inkjet head 500 from being blocked by fine bubbles, it is possible to include a configuration for discharging fine bubbles out of the inkjet head 500.

The inkjet head 500 is connected to a second end of the supply line 300 and a second end of the return line 200. The inkjet head 500 receives ink through the supply line 300 and performs inkjet printing through the nozzles, and remaining ink is discharged through the return line 200.

The pressure control device 410 is connected with a second end of the pressure control tube 400, and controls pressure in the ink container 100 to provide negative pressure in the ink container 100 so that ink in the inkjet head 500 is maintained in a meniscus state. That is, since air is continuously sucked through the pressure control tube 400, bubbles formed in the ink container 100 burst and thus liquid ink that has been spread upward may flow through the pressure control tube 400. The liquid ink introduced in the pressure control tube 400 causes a malfunction of the pressure control device 410.

A circulating pump 600 is provided on the return line 200 that returns remaining ink in inkjet head 500 to the ink container 100 and circulates ink. In the embodiment of FIG. 2, it is shown that the circulating pump 600 is provided on the return line 200, but the position thereof is not limited thereto, and the circulating pump 600 may be provided on the supply line 300. In the present invention, the circulating pump 600 may be configured such that a plurality of piezoelectric pumps is connected to each other in series and parallel at the same time. Ink is continuously circulated between the ink container 100 and the inkjet head 500 by using a piezoelectric pump capable of obtaining a flow of fluid without over pulsation (impact), so that it is possible to provide circulation of ink capable of maintaining dispersibility without affecting the meniscus state thereof. A single piezoelectric pump does not have enough flow capacity to maintain the dispersibility of the ink. However, by connecting a plurality of the piezoelectric pumps in series and in parallel, the pump is configured to obtain a sufficient head of fluid (a height of pumped fluid) and flow rate.

The number and positions of the pumps operated by a circulating pump control unit (not shown) may be adjusted. Depending on the positions of the operating pumps, serial driving and parallel driving are selectively performed or simultaneously performed. Accordingly, the piezoelectric pump is applied to induce ink circulation and the number and the positions of the operating pumps in the piezoelectric pumps are adjusted, thereby circulating ink at a proper head of fluid and flow rate that will not interfere with the maintenance of the meniscus state and increasing dispersibility of particles in ink.

Furthermore, the circulating pump control unit may include a pump controller that controls each individual piezoelectric pump. The pump controller transfers a pulse-shaped control signal to the piezoelectric pump to control the operation of the individual piezoelectric pump. When a low voltage and a low frequency signal are applied to the piezoelectric pump, the piezoelectric pump circulates ink at a low flow rate, and when a high voltage and a high frequency signal are applied to the piezoelectric pump, the piezoelectric pump circulates ink at a high flow rate. By controlling the individual pump by the pump controller, it is possible to circulate ink at various rates using the piezoelectric pump with a capacity of 3 cc/min, and when the control of the circulating pump control unit, which selectively drives the plurality of piezoelectric pumps, and the control of the pump controller, which controls the operation of the individual piezoelectric pump, are combined, it is possible to finely adjust the head of fluid and flow rate of the circulating pump that is for circulating ink.

Criteria for controlling the number and positions of the piezoelectric pumps to be operated may be variously defined, and a flow rate of ink may be criteria, and a flow sensor 700 may be installed in a flow path of the ink to measure the flow rate. The flow sensor 700 may be installed on the return line 200 as shown in FIG. 2, or may be installed on the supply line 300.

A buffer storage part 800 may be used to inject ink into the ink container without affecting the meniscus state, and when ink is added into the buffer storage part 800, additional ink may be conveniently injected without regard to meniscus. When printing is stopped in a process of supplementing ink consumed during a printing process, a loss occurs, but when ink is supplemented through the buffer storage part 800, ink may be supplemented during the printing process.

As described above, air penetrates into the inside of ink in the inkjet head 500 and the circulating pump 600 whereby fine bubbles are formed in the ink. When the fine bubbles clump in the nozzle, etc., inkjet printing cannot be performed smoothly, thus it is preferable that the fine bubbles should not be fixed to the nozzle, etc. As the result, the fine bubbles flow into the ink container 100 and are accumulated.

The ink container 100 of the embodiment is provided with a bubble removing net 120 that removes the fine bubbles in ink so that the fine bubbles included in the ink container are not accumulated, thus the fine bubbles are removed from the ink recirculated to the supply line 300.

The bubble removing net 120 is provided as a structure in which a mesh or a through hole is formed. The bubble removing net 120 interferes with movement of the fine bubbles in ink filled in the ink container 100 to allow the fine bubbles to be formed into a mass. As a size of the mass of bubbles is increased, the bubbles have strong buoyancy and float, thereby being removed from the inside of the ink.

Figure 3:
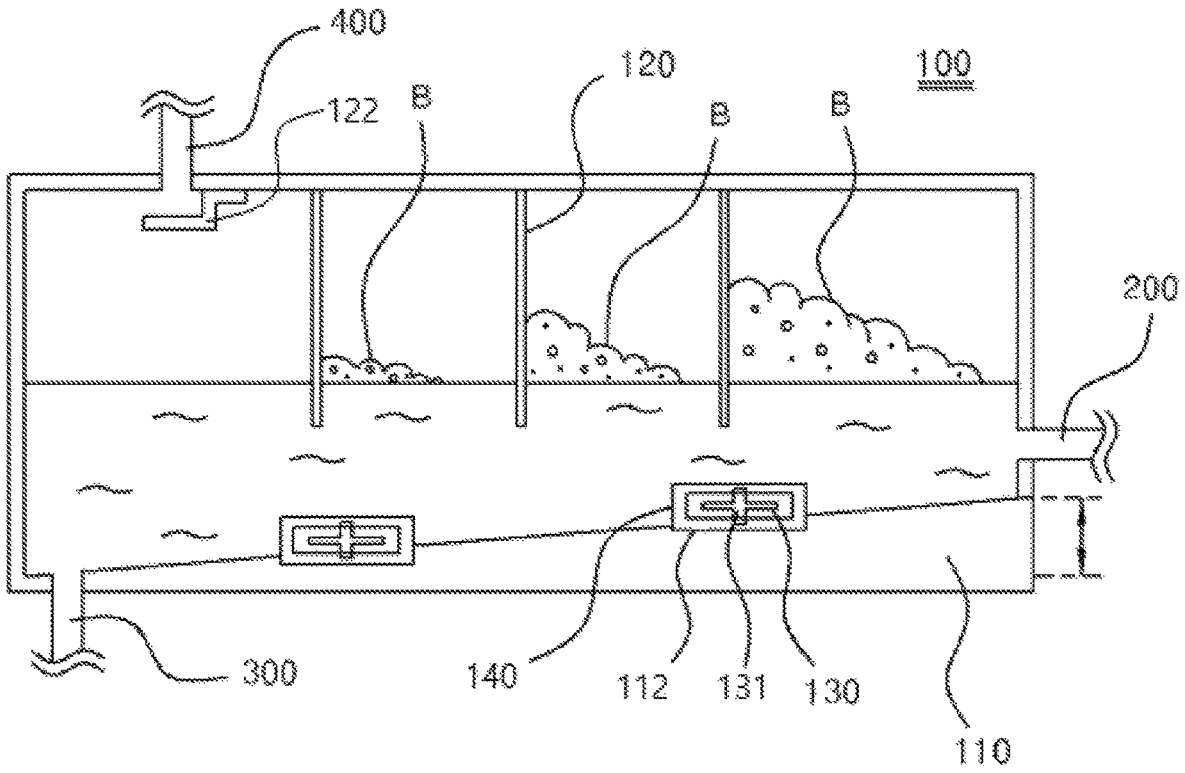
FIG. 3 is a front sectional view showing the structure of an ink container according to a second embodiment of the present invention.

Therefore, the bubble removing net 120 is preferably positioned from a ceiling to a bottom inside the ink container 100. However, since the fine bubbles are mainly located at an upper portion of ink, the bubble removing net 120 may be configured to contact with the upper portion of the ink contained in the ink container, as shown in FIG. 3. Here, since a level of the contained ink may vary during the printing process, it is necessary to determine a length of the bubble removing net 120 considering the level change.

Meanwhile, the fine bubbles floating on a surface of ink by the bubble removing net 120 form bubbles B. Here, a change occurs in ink concentration due to excessive bubbles B, and as the bubbles B burst, ink spreads in the air at an upper portion of the ink container and flows into the meniscus device, i.e. the pressure control device connected to control negative pressure in the ink container, thereby causing the malfunction thereof.

In the embodiment, since the bubble removing net 120 extends toward the upper portion of the surface of ink, it is possible to prevent the bubbles B from moving and to remove the bubbles B. As shown in the drawings, by preventing the bubbles B from moving toward the pressure control tube 400, it is possible to prevent the problem that the ink floating in the air flows into the pressure control device during the bursting of the bubbles.

Meanwhile, an installation direction of the bubble removing net 120 should be perpendicular to a flow direction of ink to obtain sufficient effect of preventing the movement of the bubbles B for removing the bubbles B. Therefore, installation positions of the return line 200 and the supply line 300 are respectively positioned at the opposite ends of the ink container 100 by being spaced apart from each other, and a bottom surface 110 is formed in a slope so that the supply line 300 side is lower than the return line 200 side, thereby allowing the flow direction of ink to be constant.

For the same reason, an inlet tube (not shown) into which additional ink flows from the buffer storage part 800 is also connected to the side connected to the return line 200.

Furthermore, it is preferable to install a plurality of bubble removing nets 120 so as to increase removal efficiency. When the plurality of bubble removing nets 120 are applied to the ink container, it is preferable that a mesh interval or a through hole size of the bubble removing net positioned at the return line 200 side is relatively large, and the mesh interval or the through hole size thereof is relatively smaller toward the supply line 300 side. By sequentially adjusting the mesh intervals or the through hole sizes, the relatively large fine bubbles are removed first, thereby improving the bubble removal efficiency and flow performance of ink.

Since the ink introduced from the return line 200 contains a large amount of fine bubbles, the most bubbles B are formed at a portion of the ink container connected to the return line 200, as shown in the drawings. In addition, since there are also bubbles B formed by the fine bubbles floating in the process of moving toward the supply line 300, when the plurality of bubble removing nets 120 is disposed spaced apart, it is also advantageous to remove the bubbles B.

Here, the pressure control tube 400 is connected to a position opposite to the return line 200 on the basis of the bubble removing net 120. That is, the pressure control tube 400 is disposed on the position opposite to a direction in which the bubbles B are filtered in order to prevent the bubbles B from bursting near the pressure control tube 400.

Additionally, a guard member 122 is installed at a position connected to the pressure control tube 400 so as to reduce risk that liquid ink flows into the meniscus device. The guard member 122 is configured to be close in a direction toward the bubble removing net 120 and to be open in a direction opposite thereto, on the basis of the connection position the pressure control tube 400. With the structure, it is possible to prevent influence by the bubbles B by blocking a direction in which the bubbles B are generated a lot, while preventing the malfunction of the meniscus device due to a filter, etc. covering an entire inlet.

Recently, as industrial fields to which the inkjet printer is applied have diversified, ink in which particles are dispersed has been used much like a case of using ink in which metal particles are dispersed for an electrode pattern. However, there is a problem of degradation of ink dispersibility that occurs when the metal particles or like sink in the ink container due to weight thereof. Specifically, when the bottom surface is inclined as in the present invention, a problem that particles included in ink with poor dispersibility sink to the bottom surface and move toward the supply line 300 becomes worse.

The ink container 100 of the present invention is provided with an agitator 130 to stir ink contained therein. As the agitator, a typical rotating agitator may be applied, and in particular, a magnetic agitator rotating by a magnetic force may be applied. As described above, the ink circulation system to which the ink container 100 of the present invention is applied is a structure that improves dispersibility through continuous circulation of ink, and the agitator 130 is added to the system. Therefore, a sufficient dispersion effect can be obtained even by stirring at a level that does not affect the meniscus state. In addition, at least two agitators are installed, so that effect of increasing dispersibility can be sufficiently maintained while each of the agitators is operated weakly.

Figure 4:
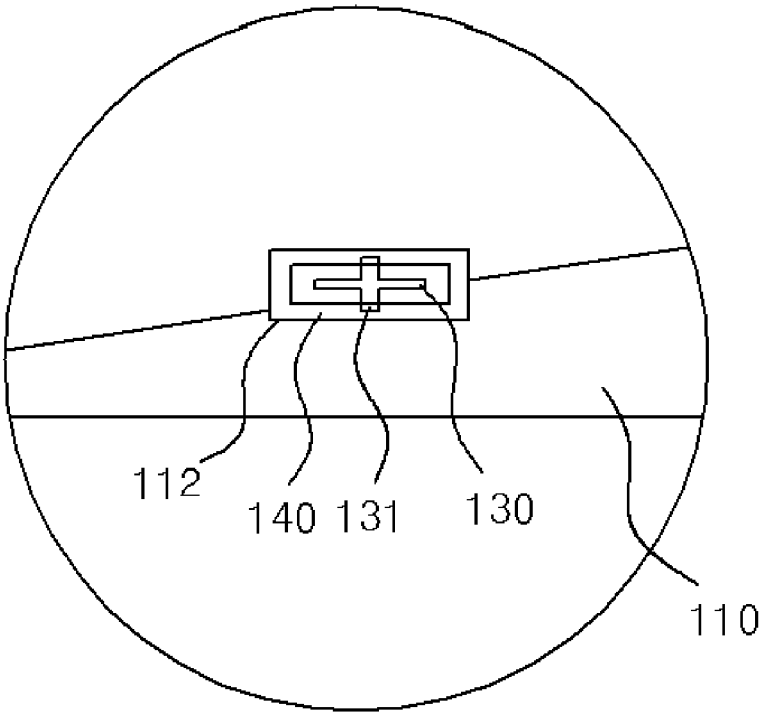
FIG. 4 is an enlarged view showing an agitator provided in the ink container according to an embodiment of the present invention.

FIG. 4 is an enlarged view showing the agitator provided in the ink container according to an embodiment.

However, since the ink container 100 of the present invention has the inclined bottom surface 110, a flow of ink may be unstable when the magnetic agitator 130 rotates at the bottom surface in a tilted state, and the agitator 130 may be moved from a designated position when the agitator 130 is not operated. In order to prevent the problem, a flat horizontal groove 112 is provided on the inclined bottom surface 110, and the agitator 130 is provided in the horizontal groove 112. In addition, a fixing frame 140 is provided in the horizontal groove 112, and opposite ends of a rotational shaft 131 protruding outside upper and lower ends of the agitator 130 rotate while being inserted into the fixing frame 140. Accordingly, the agitator 130 rotates stably at a fixed position and rotates at a predetermined distance from the bottom surface at the same time, and thus there is no problem due to friction between the agitator 130 and the bottom surface.

In the case of using the ink container of the present invention, it is possible to prevent the problem that fine bubbles in ink are accumulated in the ink container.

In addition, the ink container includes the agitator capable of performing stable movement, it is possible to increase dispersibility of particles in ink when the agitator is used together with the ink circulation system.

Although preferred embodiments of the present invention has been described for illustrative purposes, those skilled in the art will appreciate that various modifications, additions and substitutions are possible, without departing from the scope and spirit of the invention as disclosed in the accompanying claims.

What is claimed is:

1. An ink container for an inkjet printer, the ink container containing ink therein and supplying ink to an inkjet head provided with a plurality of nozzles discharging ink, the ink container comprising:

a bottom surface inclined so that a first side thereof connected to a return line through which ink is returned from the inkjet head is positioned higher than a second side thereof connected to a supply line through which ink is supplied to the inkjet head; and a bubble removing net provided between the supply line and the return line to remove bubbles from ink contained in the ink container.

2. The ink container of claim 1, wherein a pressure control tube connected to a pressure control device used to maintain meniscus in the inkjet head is connected to the pressure control device at a position opposite to a position at which the return line is connected to the container, on the basis of the bubble removing net.

3. The ink container of claim 2, wherein, in the ink container, a guard member is provided at an inlet to which the pressure control tube is connected, the guard member being configured to be closed in a direction toward the bubble removing net and to be open in an opposite direction.

4. The ink container of claim 1, wherein the bubble removing net is provided as at least two bubble removing nets that are positioned spaced apart from each other.

5. The ink container of claim 1, wherein a horizontal groove is provided parallel to the bottom surface, and an agitator is provided in the horizontal groove.

6. The ink container of claim 5, wherein the agitator is a magnetic agitator and a fixing frame is provided for preventing the agitator from being separated from a designated position thereof.

7. The ink container of claim 6, wherein a rotational shaft protrudes outside upper and lower ends of the agitator, and opposite ends of the rotational shaft are partially inserted into the fixing frame and are fixed thereto.

8. The ink container of claim 5, wherein the horizontal groove and the agitator are respectively provided as at least two groves and agitators.

9. The ink container of claim 1, wherein a buffer storage part for supplementing ink to the ink container is connected to the ink container through an inlet tube, and a position at which the inlet tube is connected to the ink container is the same as a direction of a position at which the return line is connected to the ink container, on the basis of the bubble removing net.

10. An inkjet printer comprising:

an inkjet head including a nozzle discharging ink in a liquid droplet state;

an ink container in which ink to be supplied to the inkjet head is contained;

a pressure control device connected to the ink container through a pressure control tube and maintaining a meniscus state of ink injected into the inkjet head;

a supply line connected to the ink container for supplying ink from the ink container to the inkjet head;

a return line connected to the ink container for returning ink remaining in the inkjet head to the ink container; and a circulating pump provided in the supply line or the return line to generate flow of ink, wherein the ink container of the inkjet printer is the ink container of claim 1.

* * * * *